United States Patent [19]

Kerth et al.

[11] Patent Number: 4,588,941

[45] Date of Patent: May 13, 1986

[54] CASCODE CMOS BANDGAP REFERENCE

[75] Inventors: Donald A. Kerth, Reading-Comru Township, Berks County; Navdeep S. Sooch, Emmaus, both of Pa.

[73] Assignee: AT&T Bell Laboratories, Murray Hill, N.J.

[21] Appl. No.: 700,600

[22] Filed: Feb. 11, 1985

[51] Int. Cl.[4] ..... G05F 3/20

[52] U.S. Cl. ..... 323/314; 323/907; 307/310

[58] Field of Search ..... 323/313–316, 323/907; 307/310, 296 R, 297

[56] References Cited

U.S. PATENT DOCUMENTS

| | | | |
|---|---|---|---|
| 4,249,122 | 2/1981 | Widlar | 323/313 |
| 4,263,519 | 4/1981 | Schade, Jr. | 307/297 |
| 4,287,439 | 9/1981 | Leuschner | 307/310 |
| 4,317,054 | 2/1982 | Caruso et al. | 307/297 |
| 4,375,595 | 3/1983 | Ulmer et al. | 307/297 |
| 4,380,706 | 4/1983 | Wrathall | 307/297 |
| 4,396,883 | 8/1983 | Holloway et al. | 323/313 |
| 4,443,753 | 4/1984 | McGlinchey | 323/313 |
| 4,447,784 | 5/1984 | Dobkin | 323/226 |

OTHER PUBLICATIONS

"A Precision Voltage Source", *IEEE J. of Solid-State Circuits,* vol. SC-8, No. 3, Jun. 1973, Kuijk, pp. 222–226.

"A CMOS Voltage Reference", *ibid,* vol. SC-13, No. 6, Dec. 1978, Tsividis et al, pp. 774–778.

"A Low-Voltage CMOS Bandgap Reference", *ibid,* vol. SC-14, No. 3, Jun. 1979, Vittoz et al, pp. 573–577.

"A CMOS Bandgap Voltage Reference", *ibid,* vol. SC-14, No. 3, Jun. 1979, Tzanateas et al, pp. 655–657.

"A New Curvature-Corrected Bandgap Reference", *ibid,* vol. SC-17, No. 6, Dec. 1982, Meijer et al, pp. 1139–1143.

"A Precision Curvature-Compensated CMOS Bandgap Reference", *ibid,* vol. SC-18, No. 6, Dec. 1983, Song et al, pp. 634–643.

*Primary Examiner*—Peter S. Wong

*Attorney, Agent, or Firm*—Wendy W. Koba

[57] ABSTRACT

A CMOS bandgap voltage reference which is temperature stable is disclosed. The large temperature-dependent p−tub resistors of prior art arrangements are replaced with relatively small, temperature stable p+ diffusion resistors. The increase in current level needed to compensate for the decrease in resistor value is provided by a simple cascode MOS circuit located between the ratioing resistors and the VSS potential.

4 Claims, 3 Drawing Figures

CASCODE CMOS BANDGAP REFERENCE

BACKGROUND OF THE INVENTION

1. Field of the Invention

The present invention relates to a CMOS bandgap voltage reference and, more particularly, to a CMOS bandgap voltage reference which utilizes cascoded MOS devices to provide increased temperature stability of the bandgap voltage reference.

2. Description of the Prior Art

The bandgap voltage reference, since introduced by Widlar, has become widely used as a means for providing a reference voltage in bipolar integrated circuits. In general, the bandgap reference relies on the principle that the base to emitter voltage, $V_{BE}$, of a bipolar transistor will exhibit a negative temperature coefficient, while the difference of base to emitter voltages, $\Delta V_{BE}$, of two bipolar transistors will exhibit a positive temperature coefficient. Therefore, a circuit capable of summing these two voltages will provide a relatively temperature independent voltage reference. One such circuit arrangement is disclosed in U.S. Pat. No. 4,429,122 issued to R. J. Widlar on Feb. 3, 1981. In CMOS technology, the basic Widlar arrangement may be directly applied, since bipolar devices may be created using standard CMOS processes. However, the bipolar devices available in CMOS are not as stable as those directly developed in bipolar technology, and additional control requirements are needed to provide a relatively temperature stable bandgap reference. U.S. Pat. No. 4,287,439 issued to H. Leuschner on Sept. 1, 1981, discloses one exemplary CMOS bandgap arrangement. Here, the circuit utilizes two substrate bipolar transistors with the emitter of one being larger than the other. The transistors are connected in an emitter follower arrangement with resistors in their respective emitter circuits from which a voltage is obtained to generator the bandgap reference. A later arrangement, disclosed in U.S. Pat. No. 4,380,706 issued to R. S. Wrathall on Apr. 19, 1983, relates to an improvement of on the Leuschner circuit wherein an additional transistor is inserted between the output of the amplifying stage and the substrate bipolar transistors to provide an output voltage of twice the bandgap voltage.

There exist many factors which affect the performance of these and other CMOS bandgap references. One factor not addressed by these prior art arrangements is the temperature dependence of the resistors used in association with the substrate bipolar transistors to provide the needed ratio between the emitter currents. Therefore, true temperature stability cannot be achieved without addressing this problem. One solution is disclosed in U.S. Pat. No. 4,375,595 issued R. W. Ulmer et al on Mar. 1, 1983. In the Ulmer et al arrangement, switch capacitors are used at the inputs associated with $V_{BE}$ and $\Delta_{VBE}$ to sample both voltages. Proper selection of the capacitor ratio provides a weighted sum of both voltages to the amplifier inputs which will be substantially independent of temperature. This particular solution to the resistance-related temperature coefficient problem, however, requires an external clock source and relies on the proper selection of the capacitor values used. The need remains, therefore, for a CMOS bandgap reference which provides increased temperature stability in relation to the resistor-based temperature coefficient which is relatively easy to implement and does not require external circuitry.

SUMMARY OF THE INVENTION

The problem remaining in the prior art has been solved in accordance with the present invention which relates to a CMOS bandgap voltage reference and, more particularly, to a CMOS bandgap reference which utilizes cascoded MOS devices to provide increased temperature stability of the bandgap reference as related to the temperature coefficient of the resistors used in the reference circuit.

It is an aspect of the present invention to utilize cascoded MOS devices disposed between the substrate bipolar resistors and a power supply to such augment the value of the bandgap current to a level where only relatively small resistors are needed to provide the desired bandgap voltage level. Since p+ diffusion resistors have a better temperature coefficient than the larger P tub resistors, the associated temperature stability is significantly reduced over prior art arrangements.

Another aspect of the present invention is to provide a constant current source at a minimal increase (the addition of one MOS transistor) in circuit complexity.

A further aspect of the present invention relates to providing a bandgap reference which can operate at lower supply voltages by correctly sizing the transistors used to form the cascode arrangement.

Other and further aspects of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
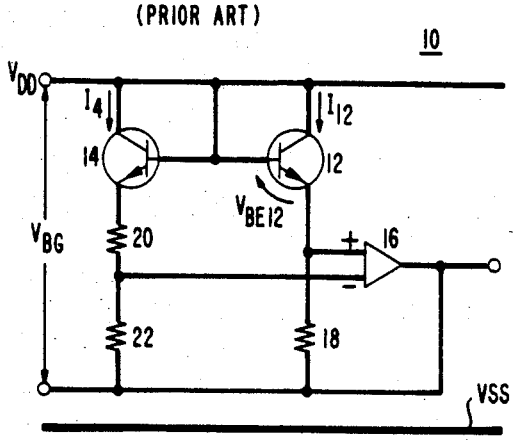
FIG. 1 (PRIOR ART)
FIG. 1 illustrates a basic prior art CMOS bandgap voltage reference.

Bandgap voltage references are frequently used in many integrated circuits. As CMOS technology becomes more and more prevalent, the need for a bandgap reference which can be formed using CMOS processes has become essential. A exemplary prior art CMOS bandgap reference 10 is illustrated in FIG. 1. A pair of bipolar transistors 12 and 14 are npn substrate transistors, where both collectors are coupled together and connected to a first power supply, denoted VDD in FIG. 1. In formation, the n−type substrate itself is defined as the collector regions, a p−type well formed in the substrate defines the base regions of transistors 12 and 14, and n−type diffusions in the p−type well form the emitters of transistors 12 and 14. It is to be noted that transistors 12 and 14 could also be pnp transistors, which would thus utilize a p−type substrate and diffusions and an n-type well. A complete description of this formation process can be found in the article "Precision Curvature-Compensated CMOS Bandgap Reference", by B. Song et al appearing in *IEEE Journal of Solid-State Circuits,* Vol. SC-18, No. 6, December 1983 at pp.

634–43. The base to emitter voltage of transistor 12, denoted $V_{BE12}$, is applied as a first, positive input to an operational amplifier 16. The detailed internal structure of operational amplifier 16 has not been shown for the sake of simplicity, since there exist many different CMOS circuits capable of performing the difference function of operational amplifier 16. A resistor 18 is connected between the emitter of transistor 12 and the output of operational amplifier 16. A resistor divider network comprising a pair of resistors 20 and 22 is connected between the emitter of transistor 14 and the output of amplifier 16, where the interconnection of resistors 20 and 22 is applied as a second, negative input to operational amplifier 16, as shown in FIG. 1. The bandgap voltage reference, $V_{BG}$, measured across the terminals as shown, can be represented by the equation $$V_{BG} = V_{BE12} + \frac{R_{22}}{R_{20}} V_T \ln\left(\frac{R_{22}}{R_{18}} \frac{I_{s14}}{I_{s12}}\right), \quad (1)$$

where $V_T$ is the thermal voltage kT/q, $I_{s12}$ is the saturation current of transistor 12 and $I_{s14}$ is the saturation current of transistor 14. In order to provide a temperature coefficient which will be substantially equal to zero, large-valued resistors (on the order of 100k) are needed to keep the bandgap current ($I_{12}+I_{14}$) at a reasonable level while still providing a substantially zero temperature coefficient. In MOS technology, the actual p−type tub is used to form resistors of such large magnitude, where a problem with this lies in the fact that p−tub resistors are well known in the art to exhibit a very large temperature coefficient. Therefore, the temperature coefficient of p−tub resistors 18, 20, and 22 will significantly degrade the temperature coefficient of bandgap voltage reference 10.

Figure 2:
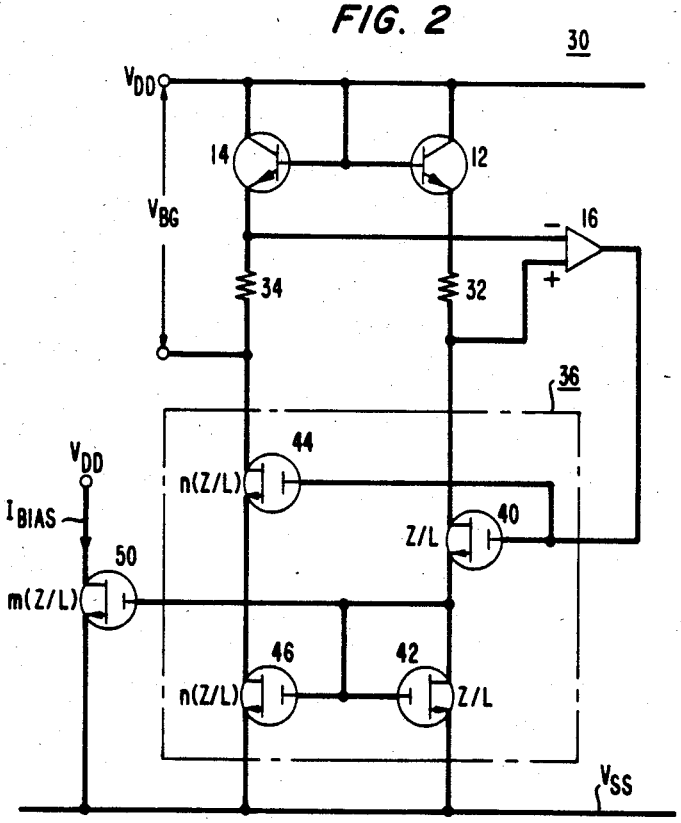
FIG. 2 illustrates an exemplary CMOS bandgap voltage reference formed in accordance with the present invention.

FIG. 2 illustrates a cascode bandgap voltage reference 30 formed in accordance with the present invention which overcome the problem related to the temperature coefficient of the p−tub resistors. As shown, resistors 18 and 20 of FIG. 1 are replaced with resistors 32 and 34, respectively, where resistors 32 and 34 are on the order of 15–20k, instead of 100k as was the case for the prior art arrangement. Therefore, resistors 32 and 34 may be formed from small p+ diffusions, which due to their decreased resistivity, exhibit a temperature coefficient which is significantly less than that associated with p−tub resistors. To compensate for the decreased resistor size, the present invention utilizes a cascode MOS circuit 36 connected as shown in FIG. 2, where the individual transistors forming circuit 36 are sized to provide the required level for the bandgap voltage. In particular, circuit 36 includes a pair of MOS transistors 40 and 42 connected in series between resistor 32 and VSS, where the drain of transistor 40 is connected to resistor 32, the source of transistor 40 is connected to the drain of transistor 42, and the gate of transistor 40 is coupled to the output of operational amplifier 16. The gate of transistor 42 is coupled to its drain, and the source of transistor 42 is connected to VSS. Circuit 36 further includes a pair of MOS transistors 44 and 46 connected in a like manner between resistor 34 and VSS, where the gate of transistor 44 is connected to the gate of transistor 40 and the gate of transistor 46 is connected to the gate of transistor 42. As shown in FIG. 2, transistors 44 and 46 are formed to have a width-to-length (Z/L) ratio n times greater than that of transistors 40 and 42. As shown below, the n factor provides the compensation for the decrease in resistor size as compared with prior art arrangements. In particular, the bandgap voltage, $V_{BG}$, of circuit 30 can be defined by the following equation $$V_{BG} = V_{BE12} + n\frac{R_{34}}{R_{32}} V_T \ln\left(n\frac{I_{s14}}{I_{s12}}\right). \quad (2)$$

Comparing equations (1) and (2), it can be seen that utilizing a bandgap reference circuit formed in accordance with the present invention results in substituting the factor $n(R_{34}/R_{32})$ the prior art factor $R_{22}/R_{20}$. Therefore, if, n=10, the value of the needed resistors may be decreased from approximately 100K to approximately 10K, thus allowing low temperature coefficient p+ diffusion resistors to be utilized in place of high temperature coefficient p−tub resistors.

An added advantage of utilizing the cascode MOS arrangement of the present invention is that a constant current source may also be realized from merely adding one additional transistor to the above-described circuit. As shown in FIG. 2, an MOS transistor 50 may be included where the gate of transistor 50 is connected to the gates of transistors 42 and 46, and the source of transistor 50 is connected to VSS. Transistor 50, as shown, comprises a Z/L ratio m times larger than transistors 40 and 42. The current flowing through transistor 50, denoted $I_{BIAS}$, is defined by the following expression $$I_{BIAS} = \frac{m}{R_{32}} V_T \ln\left(n\frac{I_{s14}}{I_{s12}}\right). \quad (3)$$

An additional advantage of the present invention arises from the fact that the output of operational amplifier 16 does not have to sink the bandgap current, as does the prior art arrangement of FIG. 1. Instead, the output of operational amplifier 16, as stated above is coupled to cascode circuit 36 at the gate terminals of transistors 40 and 44.

Figure 3:
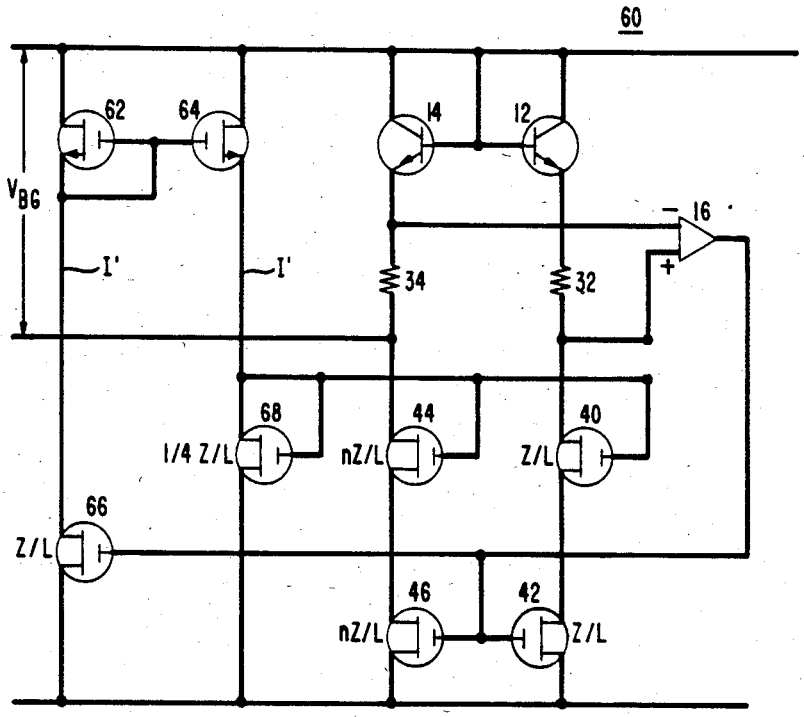
FIG. 3 illustrates an alternative CMOS bandgap voltage reference formed in accordance with the present invention which can operate at lower supply voltages than the arrangement illustrated in FIG. 2.

The minimum range between supply voltages VDD and VSS for the circuit of FIG. 2 can be expressed as $$(VDD-VSS)_{min} = V_{BG} + V_{TH(n)} + 2V_{ON}, \quad (4)$$

where $V_{TH(n)}$ is defined as the threshold voltage for transistors 44 and 46 and $V_{ON}$ is also associated with transistors 44 and 46. In order to operate at lower supply voltages, a ratioed cascode current mirror, included in the circuit illustrated in FIG. 3, may be utilized to eliminate the $V_{TH(n)}$ term from equation (3). As shown, a current mirror formed from a pair of MOS transistors 62 and 64 supply a like current I' to the drain terminals of a pair of transistors 66 and 68, respectively. Transistor 66 is connected between transistor 62 and VSS, where the gate of transistor 66 is connected to the gates of transistors 42 and 46. The gate to source voltage, $V_{GS}$, of transistor is equal to the quantity $V_{TH(n)}+V_{ON}$. In order to eliminate the $V_{TH(n)}$ component, transistor 68, as shown in FIG. 3, is chosen to comprise a Z/L ratio which is one-fourth that of transistors 40 and 42. Therefore, it follows that $V_{GS}$ of transistor 68 is equal to the quantity $V_{TH(n)}+2V_{ON}$. Since the drain to source voltage, $V_{DS}$, for both transistors 44 and 46 has been altered to equal $V_{ON}$, the minimum voltage difference between VDD and VSS can be expressed as $$(VDD - VSS)_{min} = V_{BG} + V_{ON(44)} + V_{ON(46)} = V_{BG} + 2V_{ON}. \quad (5)$$

What is claimed is:

1. A voltage reference circuit for providing as an output a bandgap reference voltage which is substantially independent of temperature, said reference circuit comprising differential amplifying means including a first and a second input terminal and an output terminal;

a first bipolar transistor including a collector, a base, and an emitter, the collector and base connected to a first reference potential, said first bipolar transistor having a base to emitter voltage defined as $V_{BE}$;

a second bipolar transistor including a collector, a base, and an emitter, the collector and base connected to said first reference potential and the emitter connected to said first input terminal of said differential amplifying means;

a first resistor connected between the emitter of said first transistor and said second input terminal of said differential amplifying means;

a second resistor connected to the emitter of said second bipolar transistor; and an MOS cascode transistor arrangement connected in series between said first and second resistors and a second reference potential and further connected to the output terminal of said differential amplifying means, said MOS cascode transistor arrangement including a first plurality of MOS transistors, each MOS transistor having a source, drain and gate terminal and formed to comprise a width-to-length ratio defined as Z/L, said first plurality of MOS transistors connected between said first resistor and said second reference potential; and a second plurality of MOS transistors, each MOS transistor having a source, drain and gate terminal and formed to comprise a width-to-length ratio defined as n(Z/L), n being defined as a width-to-length size factor, said second plurality of MOS transistors connected between said second resistor and said second reference potential, said MOS cascode transistor arrangement providing the output bandgap reference voltage which is proportional to the sum of said base-to-emitter voltage of said first transistor and the ratio of said second and first resistors multiplied by both said size factor n and the difference in base-to-emitter voltages of said first and second transistors.

2. A voltage reference circuit as defined in claim 1 wherein the MOS cascode transistor arrangement comprises a first and a second MOS transistor, forming the first plurality of MOS transistors, connected in series between the first resistor and the second reference potential, wherein the gate terminal of the first MOS transistor is connected to the output of the differential amplifying means and the gate of the second MOS transistor is connected to the interconnection of the source of the first MOS transistor and the drain of the second MOS transistor; and a third and a fourth MOS transistor, forming the second plurality of MOS transistors, connected in series between the second resistor and the second reference potential, wherein the gate terminal of said third transistor is connected to the gate terminal of said first transistor and the gate terminal of said fourth transistor is connected to the gate terminal of said second transistor.

3. A voltage reference circuit as defined in claim 2 wherein said circuit further comprises a fifth MOS transistor including a source, drain and gate for providing a reference current, the gate of said fifth MOS transistor connected to the interconnected gates of the second and fourth MOS transistors and the source of said fifth transistor connected to the second reference potential, said fifth MOS transistor comprising a width-to-length ratio of m(Z/L) and providing a drain currents as the output reference current related to the ratio of m and the first resistor multiplied by a constant value related to the first and second bipolar transistors.

4. A voltage reference circuit as defined in claim 2 wherein said circuit further comprises an MOS cascode current mirror disposed between the first and second reference potentials and connected to the cascode MOS transistor arrangement for biasing said cascode MOS transistor arrangement at a predetermined value which decreases the voltage difference between said first and second reference potentials.

* * * * *